US010283918B2

(12) United States Patent
Schyrocki et al.

(10) Patent No.: US 10,283,918 B2
(45) Date of Patent: May 7, 2019

(54) ELECTRICAL TERMINAL BLOCK

(71) Applicant: Phoenix Contact GmbH & Co. KG, Blomberg (DE)

(72) Inventors: Olaf Schyrocki, Bad Pyrmont (DE); Christian Kloppenburg, Büren Wewelsburg (DE); Dennis Habirov, Bielefeld (DE); Wjatscheslaw Janzen, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/546,349

(22) PCT Filed: Feb. 11, 2016

(86) PCT No.: PCT/EP2016/052911
§ 371 (c)(1),
(2) Date: Jul. 26, 2017

(87) PCT Pub. No.: WO2016/131703
PCT Pub. Date: Aug. 25, 2016

(65) Prior Publication Data

US 2018/0269636 A1 Sep. 20, 2018

(30) Foreign Application Priority Data

Feb. 17, 2015 (DE) ..... 10 2015 102 257

(51) Int. Cl.
*H01R 9/24* (2006.01)
*H01R 9/26* (2006.01)
(Continued)

(52) U.S. Cl.
CPC ..... *H01R 13/7033* (2013.01); *H01R 9/2408* (2013.01); *H01R 9/2491* (2013.01);
(Continued)

(58) Field of Classification Search
CPC .. H01R 13/703; H01R 9/2491; H01R 9/2633; H01R 13/7033; H01R 31/08;
(Continued)

(56) References Cited

U.S. PATENT DOCUMENTS 3,289,146 A * 11/1966 Tuchel ..... H01R 13/112 439/630
4,773,867 A * 9/1988 Keller ..... H04Q 1/142 379/325

(Continued)

FOREIGN PATENT DOCUMENTS

DE 10 2010 017 964 A1 10/2011

*Primary Examiner* — Gary F Paumen
(74) *Attorney, Agent, or Firm* — David S. Safran; Roberts Mlotkowski Safran Cole & Calderon, P.C.

(57) ABSTRACT

An electric terminal block having a block housing, two conductor connection elements, two current bars, and two additional current bar pieces. Each current bar has a connection portion, and first and second contact portions, each connection portion being paired with a conductor connection element. To obtain a reliable switching sequence when plugging and unplugging an operating or test plug, the terminal housing is equipped with two spring elements, each of which has a connection portion and an elastic contact portion; each of the spring elements is electrically connected to one of the current bar pieces; the contact portions together form a second contact region for receiving the plug, and being mutually spaced when the plug is not plugged in. The contact region of the spring elements is arranged in front of the contact region of the current bars in the plug-in direction of the plug.

13 Claims, 8 Drawing Sheets

(51) Int. Cl.
*H01R 24/58* (2011.01)
*H01R 13/703* (2006.01)

(52) U.S. Cl.
CPC ..... *H01R 9/2633* (2013.01); *H01R 9/2666* (2013.01); *H01R 24/58* (2013.01); *H01R 2201/20* (2013.01); *H01R 2201/22* (2013.01)

(58) Field of Classification Search
CPC ..... H01R 2201/20; H01R 2103/00; H01R 24/58; H01R 29/00; H01R 9/2666; H01R 9/21408; H01R 2201/22
USPC ... 439/188, 49, 712, 715, 857, 94, 532, 716, 439/721, 834, 835
See application file for complete search history.

(56) References Cited

U.S. PATENT DOCUMENTS

| | | | | |
|---|---|---|---|---|
| 5,546,267 | A * | 8/1996 | Frederiksen | H01R 9/2441 361/119 |
| 5,658,172 | A * | 8/1997 | Schmidt | H01R 9/26 439/709 |
| 7,271,357 | B2 * | 9/2007 | Ostmeier | G01R 1/0416 200/51.09 |
| 7,666,037 | B2 | 2/2010 | Diessel | |
| 8,772,654 | B2 | 7/2014 | Tziviskos et al. | |
| 9,153,916 | B2 | 10/2015 | Schloo et al. | |
| 9,476,909 | B2 | 10/2016 | Kloppenburg | |
| 2015/0147909 | A1 | 5/2015 | Gebhardt et al. | |

* cited by examiner

ELECTRICAL TERMINAL BLOCK

BACKGROUND OF THE INVENTION

Field of the Invention

The invention relates to an electrical terminal block, with a terminal housing, with at least two conductor connecting elements located in it, with two conductor bars and with two other conductor bar pieces. In addition, the invention relates to a plug system formed of a block of terminal blocks, at least one plug-in jumper and an operating plug or test plug, the b lock of terminal blocks having at least two blocks which are located next to one another.

Description of Related Art

Electrical terminal blocks have been known for decades and are used in the millions in the wiring of electrical installations and devices. The terminals are often latched onto mounting rails which for their part can be located in a plurality in a control cabinet. Moreover terminal blocks can also be mounted severally as a block of terminal blocks in a wall opening, in particular in an opening in a control cabinet wall or control cabinet door. This has the advantage that one side of the terminals, the operator side, is accessible from outside the control cabinet without the control cabinet having to be opened, and the other side of the terminal, the connection side, is only accessible when the control cabinet has been opened.

In particular screw-type or tension spring terminals are used in terminal blocks as conductor connecting elements. The clamping principle in tension spring terminals is similar to that of screw technology. While in the screw terminal a tension sleeve draws the conductor against the conductor bar by actuating the clamping screw, in tension spring terminals this task is assumed by the tension spring. In addition, insulation piercing connecting devices and in particular leg spring terminals are also being increasingly used.

Electrical terminal blocks are often connecting terminals so that they have at least two conductor connecting elements which are electrically connected to one another via an electrically conductive connecting bar, the conductor bar. In addition to this basic type of terminal blocks which is often also called a feed-through terminal, there are a host of other terminal block types which are adapted specially to the specific applications (compare Phoenix Contact Catalog Terminal Blocks CLIPLINE 2011, pp. 2-11). Examples include protective conductor terminals, isolating blade terminals and installation terminals.

In switching, measurement, test and control engineering, pass-through terminals with a disconnect possibility are often used. The disconnect possibility which is implemented in this terminal block, i.e. the gap provided in the conductor bar, makes it possible to plug-in various plugs with different functions into the terminal housing of the terminal block which then make contact with the conductor bar at the gap. In particular plugs can also be test plugs in addition to simple isolating plugs or through-connectors; test plugs can have special components and can enable the checking of proper operation of the circuit which is connected to the terminal block. Since electrical terminal blocks are usually made disk-shaped, they are generally plugged together with several other electrical terminal blocks into a block of terminal blocks. Then a number of test plugs corresponding to the number of terminal blocks can be plugged into such a block of terminal blocks.

German Patent Application DE 10 2006 052 894 A1 and corresponding U.S. Pat. No. 7,666,037 B2 disclose a terminal block, a test plug and a test terminal block consisting of a plurality of terminal blocks which are located next to one another and of a corresponding number of test plugs. The individual terminal blocks each have two conductor bars whose contact sections make contact with one another when the corresponding plug of a test plug is not plugged into the contact region formed by the contact sections. If the plug of a test plug is fully plugged into the contact region, the two contact sections are separated from one another by the plug, the current flow then being routed via the plug so that a test process can be carried out. The terminal block and the assigned test plug then work according to the break contact principle since the connection between the two conductor bars of the terminal block is opened when the plug has been fully inserted into the contact region.

In order to ensure reliable and defined contact states when the test plug is plugged into the contact region, in these known electrical terminal blocks the conductor bars are made such that they form two contact regions which are located behind one another in the insertion direction of the plug of the test plug. Forming a defined second contact region which is located in the insertion direction of the plug upstream of the first contact region ensures that when the plug is inserted first a reliable electrical connection between the plug of the test plug and the two conductor bars arises before the first contact region is opened as the plug continues to be inserted, as a result of which the two conductor bars are then electrically separated from one another.

In addition to these terminal blocks or test terminal blocks, practice also includes test disconnect blocks, in particular those from the Russian company Cheaz, in which the elastic contact sections of the conductor bars, which together form an elastic contact region, are spaced apart from one another and are then connected to one another in an electrically conductive manner only when a plug of an operating or test plug is plugged into the contact region. The electrically conductive connection between the contact sections or between the conductor bars takes place via the inserted plug which has, for this purpose, two interconnected contact sections which make contact with the contact sections of the conductor bars when the plug is inserted. These terminal blocks thus work according to the make contact principle.

These terminal blocks with gaps are used, in particular, for connection of current transformers. One important functional feature is that a current transformer is short circuited as soon as the test or operating plug is pulled out of the terminal block.

For this purpose, in the above described test disconnect blocks, there are jumper plugs via which at least two conductor bars are connected to one another in an electrically conductive manner so that the assigned conductor connecting elements are short circuited. In this way then a current transformer which is connected to the conductor connecting elements is also short circuited. The jumper plugs are located between the opposing contact sections of the conductor bars such that they make contact with the contact section of one conductor bar when a plug has not been inserted. If a test or operating plug is inserted into the electrical terminal block or into a test terminal block, the opposite contact sections of two conductor bars are forced somewhat apart. This leads to the contact sections being connected to one another via the electrically conductive plug. Moreover, the insertion of the plug into the contact region also leads to the connection between the contact section and one leg of the jumper plug being broken since the elastic contact section is forced away from the rigidly arranged jumper plug by the insertion of the plug. The jumper plug thus ensures an electrically conductive connection between adjacent contact sections or conductor bars, the cross-jumpering being automatically interrupted when a test or operating plug is being plugged in.

But, these test terminal blocks, which have been used for decades in practice, have the disadvantage that the structure and installation of the test terminal blocks is relatively complex. In particular, the mounting of the jumper plugs on the bottom of the housing of the test terminal block is relatively labor-intensive, since to do this the elastic contact regions must be deflected against their spring force. At the same time the jumper plugs must be fastened to the bottom of the housing using a screw, its having to be ensured that the contact sections with which the jumper plugs have made contact are deflected the same amount so that equally good contact is also ensured later between the jumper plug and the contact sections.

An electrical terminal block in which the above described disadvantages are avoided is known from German Patent Application DE 10 2011 113 333 A1 and corresponding U.S. Pat. No. 9,153,916 B2. In this electrical terminal block on which the invention is based, the two conductor bars each have a connection section, a first contact section, and in addition, a second contact section. The connection sections are each assigned to one conductor connecting element, specifically part of the conductor connecting element which is made as a screw-type terminal, while the first contact sections together form a first contact region for accommodating the plug of an operating plug or a test plug. The first contact sections are spaced apart from one another here and only when the plug has been plugged in are they connected to one another in an electrically conductive manner via the plug so that the make contact principle is also implemented in these terminal blocks.

In at least one of the conductor bar pieces, a recess is formed for plugging in one leg of a plug-in jumper, one of the conductor bar pieces at a time being assigned to one of the conductor bars such that the second contact section of one conductor bar makes contact with the assigned conductor bar piece when a plug has not been plugged in. Conversely, if a plug is plugged into the contact region, the two conductor bars are deflected such that the second contact section of one conductor bar is spaced apart from the assigned conductor bar piece.

In the electrical terminal block known from German Patent Application DE 10 2011 113 333 A1 and corresponding U.S. Pat. No. 9,153,916 B2, cross-jumpering to an adjacent terminal block thus takes place by a respective leg of a plug-in jumper being plugged into the recess which has been provided for this purpose in the respective conductor bar pieces of two terminal blocks. The conductor bar pieces are thus used for electrical cross connection to one adjacent terminal block via a plugged-in plug-in jumper. The electrical cross connection between two conductor connecting elements of two terminal blocks takes place via the respective conductor bars, the conductor bar pieces and the plug-in jumper which has been plugged in. The conductor bars of the terminal blocks are connected in an electrically conductive manner on the one hand using their connection section to the conductor connecting element and on the other using their second contact section to the respective conductor bar piece.

In these electrical terminal blocks thus installation is greatly facilitated since the arrangement of additional jumper plugs on the bottom of the housing can be omitted. Even if a cross connection to an adjacent terminal block is automatically achieved when an operating plug is pulled or disconnection of the cross connection takes place automatically when an operating plug or a test plug is plugged in for these terminal blocks, under certain unfavorable conditions a brief interruption of the circuit can take place.

SUMMARY OF THE INVENTION

Therefore, the object of this invention is to make available the initially described electrical terminal block which is especially well suited for connection of current transformers, it is to be ensured that when an operating plug or a test plug is plugged in, a cross connection between conductor connecting elements of two adjacent terminal blocks is only opened when the two conductor bars of one terminal block are reliably electrically connected to one another beforehand via the plugged-in operating plug or the test plug. Moreover, the conductive connection between the two conductor bars will be broken when an operating plug or a test plug is pulled only when the cross connection between two conductor connecting elements of two adjacent terminal blocks is reliably established beforehand.

This object is achieved in the initially described electrical terminal block in that there are two spring elements in the terminal housing which each have a connecting section and an elastic contact section, the connecting sections each being connected in an electrically conductive manner to one of the conductor bar pieces. The contact sections of the spring elements together form a second contact region for accommodating the plug of an operating plug or a test plug, these contact sections also being spaced apart from one another when a plug has not been plugged in. Moreover, the spring elements are located in the terminal housing such that the contact region of the spring elements is located in the plug-in direction of the plug upstream of the contact region of the conductor bars.

In accordance with the invention, in addition, there are thus two spring elements in the terminal housing so that, when the plug of an operating plug or a test plug is plugged in, the plug first makes contact with the contact sections of the spring elements before the plug makes contact with the contact sections of the conductor bars. Conversely, when the plug of an operating plug or a test plug is being unplugged, the contact sections of the spring elements still have contact with the plug even after the plug has already been pulled out of the contact region of the conductor bars. Since the two spring elements are each connected in an electrically conductive manner via their connecting section to one of the two conductor bar pieces, it is thus ensured that for two electrical terminal blocks in accordance with the invention which are located next to one another, the cross connection between the two terminal blocks when an operating plug or test plug is plugged in is opened in a lagging manner and when the operating or test plug is pulled it is closed in advance. If the electrical terminal blocks in accordance with the invention are used to connect current transformers, a reliable switching sequence is thus ensured when the current transformer is short circuited.

If the plug of an operating or test plug is plugged into the electrical terminal block in accordance with the invention, this first leads to the plug with its electrically interconnected contact sections making contact with the two contact sections of the two spring elements in the second contact region. In this way, the two conductor connecting elements of the terminal block are electrically interconnected via the two conductor bars, the conductor bar pieces which are electrically connected to the two conductor bars, the two spring elements and the plug of the operating or test plug. When there are two terminal blocks in accordance with the invention located next to one another the cross connection between the terminal blocks via a plugged-in plug-in jumper remains since the plugs of the plug-in jumper is [sic] still each electrically connected via a conductor bar piece to the contact section of the assigned conductor bar. In this position of the operating or test plug the cross connection is still present via the conductor bar, the conductor bar piece and the plug-in jumper.

If the plug of the operating or test plug continues to be plugged into the electrical terminal block so that the plug in the first contact region makes contact with the two contact sections of the two conductor bars, the two conductor connecting elements of the electrical terminal block are electrically connected to one another via the two conductor bars and the plug of the operating or test plug. By inserting the plug into the first contact region, not only are the first contact sections of the conductor bars forced apart from one another, but the two contact sections of the conductor bars are also moved away from the respectively assigned conductor bar piece so that the second contact sections are spaced away from the respective conductor bar piece and thus the electrically conductive connection is broken at this site.

As long as the contact sections of the plug of the operating or test plug however still make contact with the contact sections of the spring elements, the cross connection to an adjacent electrical terminal block via a plugged-in plug-in jumper is not interrupted. Only when the plug of the operating or test plug has been plugged completely into the electrical terminal block, the contact sections of the plug no longer making contact with the contact sections of the spring elements, is the cross connection interrupted. This ensures that the cross connection of two adjacent electrical terminal blocks via a plugged-in plug-in jumper is only interrupted when the electrical connection of the two conductor bars via the plug of the operating or test plug is ensured beforehand and the cross connection is thus reliably opened in a lagging manner.

According to one advantageous configuration of the terminal block in accordance with the invention, the elastic contact sections of the two spring elements are each made roughly V-shaped. In this way, the spring elements can be produced especially easily as static bending parts, the two contact sections of the two spring elements facing one another being used at the same time as a type of entry funnel for the plug of the operating or test plug which is to be plugged in.

According to another advantageous configuration of the electrical terminal block in accordance with the invention, in the connecting section of at least one of the two spring elements, a recess is formed which corresponds to the recess in the assigned conductor bar piece. The leg of a plug-in jumper is then at the same time plugged in through the recess in the connecting section of the spring element and through the recess in the conductor bar piece. Preferably, both in the two conductor bar pieces and also in the two connecting sections of the two spring elements are recesses formed which correspond to one another so that the two conductor bar pieces and the two spring elements are made the same. It is then possible to plug the one leg of one plug-in jumper into the two conductor bar pieces.

The two conductor bars, the two conductor bar pieces and the two spring elements can each be made by punching out and bending one piece of metal over and aside. In doing so, one conductor bar piece and one spring element can also be produced from at least one common piece of metal and connected to one another. For example, the spring element and the conductor bar piece can be formed from at least a respective metal strip, the two metal strips being located parallel and next to one another and being connected to one another in a connecting region. After the interconnected metal strips are punched out, the two metal strips are folded along the connecting region so that the two metal strips lie on top of one another with their backs. Then, the conductor bar piece and the spring element are each brought to their final form by bending over and aside. To achieve higher stability, for example, the conductor bar piece itself can also be made in two layers, i.e., can be formed from two metal strips lying on top of one another.

According to an alternative configuration, it is provided that the two conductor bar pieces and the two spring elements are produced from individual metal strips. Before installation then one conductor bar piece at a time is tightly joined to the connecting section of one spring element, in particular soldered, welded or riveted.

Moreover, the two conductor bars each preferably are formed of two individual elongated metal strips which are connected to one another in an electrically conductive manner, in particular welded, soldered or riveted to one another. The connecting section of one conductor bar is then formed by the first metal strip, while the two contact sections are formed by the second metal strip. On the one hand, this simplifies the production of the conductor bars, on the other hand it enables the use of different materials or different cross sections which have been selected according to the respectively required stiffness and spring property for the connecting section on the one hand and the contact sections on the other. The first metal strip which forms the contact section can be made relatively rigid, while the second metal strip itself is made as a contact spring so that both good contact-making between the first contact section and a plugged-in plug and also between the second contact section and the assigned conductor bar piece is ensured.

In a plug system comprising a block of terminal blocks, at least one plug-in jumper and one operating or a test plug, the block of terminal blocks having at least two terminal blocks in accordance with the invention located next to one another, it is provided that the individual plugs of the operating plug or test plug each have two contact sections whose length is less than the maximum plug-in depth T of the plugs into the terminal block.

This configuration of the plugs of the operating plug or of the test plug easily ensures that when the operating plug or the test plug has been plugged fully onto the corresponding block of terminal blocks, the two conductor connecting elements of one electrical terminal block are connected to one another in an electrically conductive manner only via the two conductor bars and the plug of the operating plug or the test plug. Both in normal operation in which the operating plug has been completely plugged on and also in test operation in which the test plug is completely plugged on, the two spring elements are thus not electrically connected to the two conductor connecting elements. The function of the two spring elements which was described above in conjunction with the electrical terminal block in accordance with the invention, specifically the lagging opening of the cross connection between two terminal blocks when an operating plug or a test plug is being plugged in and the advanced closing of the cross connection when an operating or a test plug is being pulled, thus prevails only during the plugging-in and unplugging process.

According to one advantageous development of the invention, it is provided that one insulation section at a time is connected to the side of the contact sections which faces away from the tip of the individual plugs of the operating plug or the test plug. The two contact sections of the plug of one operating plug are preferably each connected to one another on the side facing away from the tip of the plug, the connecting region of the two contact sections being covered by the insulation sections.

In contrast thereto, the two contact sections of the plugs of a test plug are preferably not connected to one another. An electrical connection of the two contact sections of one plug of a test plug can, if necessary, be easily established by the user by the two contact sections being connected to one another via a plug-in jumper. To do this, at least a respective recess for plugging in a leg of the plug-in jumper is made in the two contact sections of a plug.

The electrical terminal blocks, which together form the electrical terminal block, are each made disk-shaped. So that several terminal blocks can together form a block of terminal blocks, the individual terminal blocks are preferably mechanically connected to one another, for which the terminal blocks are latched together via corresponding latching elements which are made in the terminal housing. The latching elements preferably formed of latching pins which are located on one side of the terminal housing and of corresponding latching recesses which are made on the other side of the terminal housing.

Accordingly the operating plug and the test plug can also be composed of disk-shaped individual components which are each latched to one another. In addition, in particular the test plug can have a grip which is connected to two fastening parts which are located on one side of the plurality of individual components at a time.

In particular, there are now a plurality of possibilities for configuring and developing the electrical terminal blocks in accordance with the invention. In this regard reference is made to the following description of preferred exemplary embodiments in conjunction with the accompanying drawings.

BRIEF DESCRIPTION OF THE DRAWINGS

FIG. 2 shows the terminal block according to FIG. 1, with an operating plug which has not yet been plugged in, FIG. 6 shows the terminal block with an operating plug which has been fully plugged in, FIG. 7 is a perspective view of a block of terminal blocks and of an operating plug which has not yet been plugged in, and FIG. 8 is a perspective view of a block of terminal blocks and of a test plug which has not yet been plugged in.

DETAILED DESCRIPTION OF THE INVENTION

Figure 1:
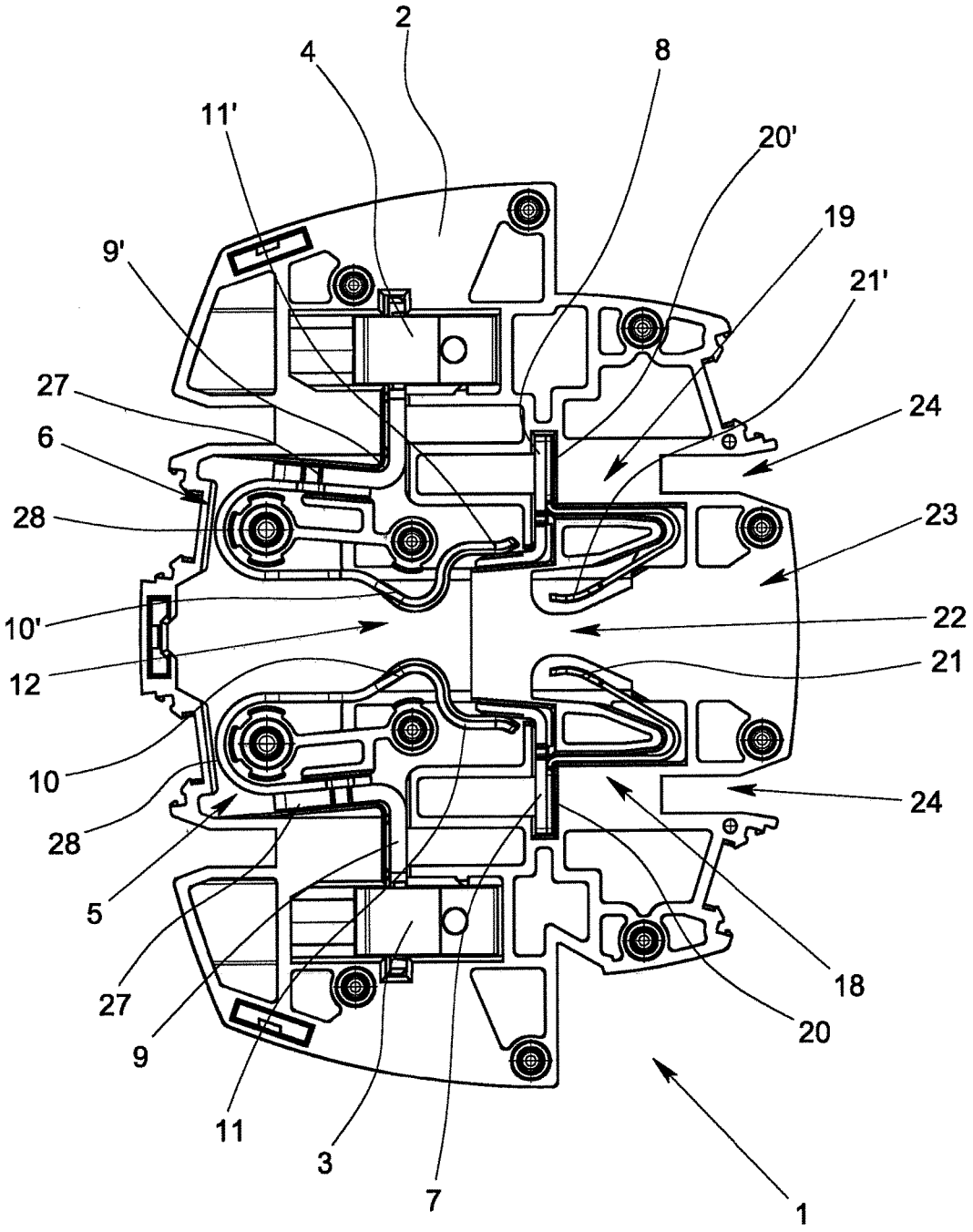
FIG. 1 is a side view of an exemplary embodiment of an electrical terminal block.

FIG. 1 shows an individual electrical terminal block 1 which has a terminal housing 2 which in the illustrated exemplary embodiments can be fastened in an opening of a wall, in particular a control cabinet wall. Within the terminal housing 2 there are two conductor connecting elements 3, 4 which in the illustrated exemplary embodiment are screw terminals. But, other types of connection elements, for example, tension spring terminals, insulation piercing connecting devices or leg spring terminals can be used equally well as conductor connecting elements.

In the terminal housing 2, there are moreover two more conductor bars 5, 6 which are made identically and which are arranged symmetrically to one other and two conductor bar pieces 7, 8 which are likewise made identically and which are arranged symmetrically to one other. The conductor bars 5, 6 each have a connection section 9, 9' on one end which is assigned to a respective one of the two conductor connecting elements 3, 4. Moreover, the two conductor bars 5, 6 each still have a first contact section 10, 10' and a second contact section 11, 11'. The two first contact sections 10, 10' together form a first contact region 12 for accommodating the plug 13 of an operating plug 14 (shown in FIGS. 2-5) or a test plug 15 (shown in FIG. 8).

The second contact sections 11, 11' are made on the second end of the conductor bars 5, 6 which is opposite the connection sections 9, 9', the two second contact sections 11, 11' each being used for making contact with the conductor bar pieces 7, 8. The second contact sections 11, 11', due solely to the spring force of the conductor bars 5, 6, adjoin the conductor bar pieces 7, 8, the contact surfaces corresponding to one another and the spring force being sufficient to ensure a good current transfer between the conductor bars 5, 6 and the conductor bar pieces 7, 8. Due to the solely elastic contact of the second contact sections 11, 11' with the conductor bar pieces 7, 8, this conductive connection can be easily interrupted when a plug 13 of an operating plug 14 or a test plug 15 is inserted into the contact region 12 since then the two conductor bars 5, 6 are forced apart, and thus, the second contact sections 11, 11' are moved away from the conductor bar pieces 7, 8.

In the exemplary embodiment of the electrical terminal block 1 shown in the figures, a respective recess for plugging in a leg 16 of a plug-in jumper 17 is made in the two conductor bar pieces 7, 8. In this way, a cross-jumpering with an adjacent terminal block 1' can be easily produced via the short conductor bar pieces 7, 8 which are located in the terminal housing 2 when one leg 16 of a plug-in jumper 17 is plugged into the recesses of one conductor bar piece 7, 8 of two adjacent terminal blocks 1, 1' at a time.

In addition to the conductor bars 5, 6 and the conductor bar pieces 7, 8, in the terminal housing 2 of the electrical terminal block 1, there are two more spring elements 18, 19 which each have one connection section 20, 20' and one elastic contact section 21, 21'. The connection sections 20, 20' are each connected in an electrically conductive manner to one of the conductor bar pieces 7, 8, the electrical connection taking place, for example, by welding or riveting. Alternatively, a respective conductor bar piece 7, 8 and a respective spring element 18, 19 can also be made in one piece, then the conductor bar piece and the spring element being punched out of a metal piece and bent. The contact sections 21, 21' of the two spring elements 18, 19 facing one another together form a second contact region 22 which is located in the plug-in direction E of the plug 13 upstream of the contact region 12 of the conductor bars 5, 6. In the same manner, as the contact sections 10, 10' of the conductor bars 5, 6, the contact sections 21, 21' of the spring elements 18, 19 are also spaced apart from one another when a plug 13 has not been plugged into the second contact region 22 (compare FIGS. 1 and 2).

FIGS. 2 to 6 show an electrical terminal block 1 in accordance with the invention and an operating plug 14, the plug 13 of the operating plug 14 in the individual figures being plugged different distances into the terminal block 1 or into an opening 23 made in the terminal housing 2. In the contact region of the plug 13, part of the wall of the terminal housing 2 and of the side wall of the plug 13 is omitted so that contact-making between the plug 13 and the terminal block 1 can be seen.

Figure 2:
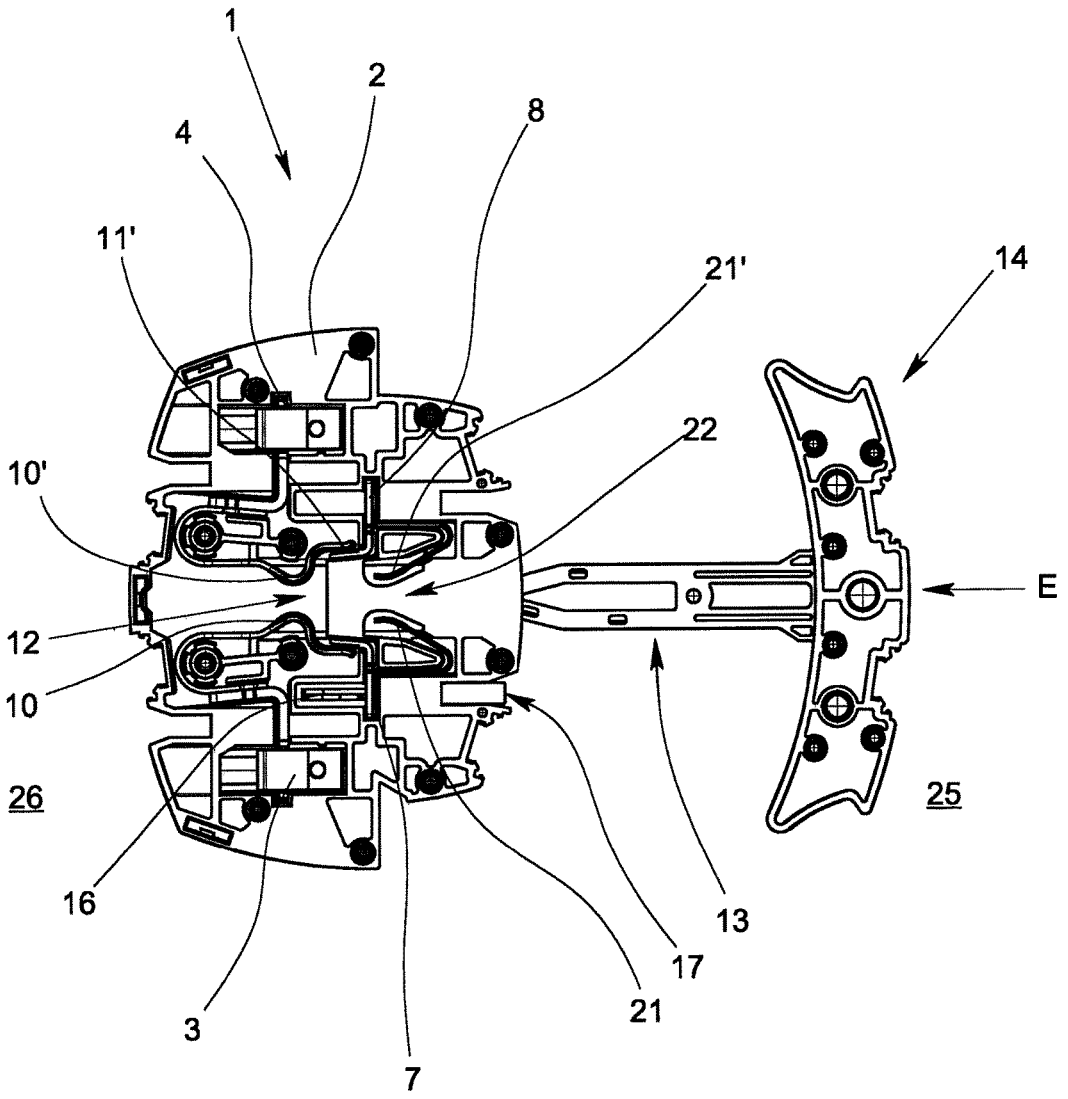
Figure 3:
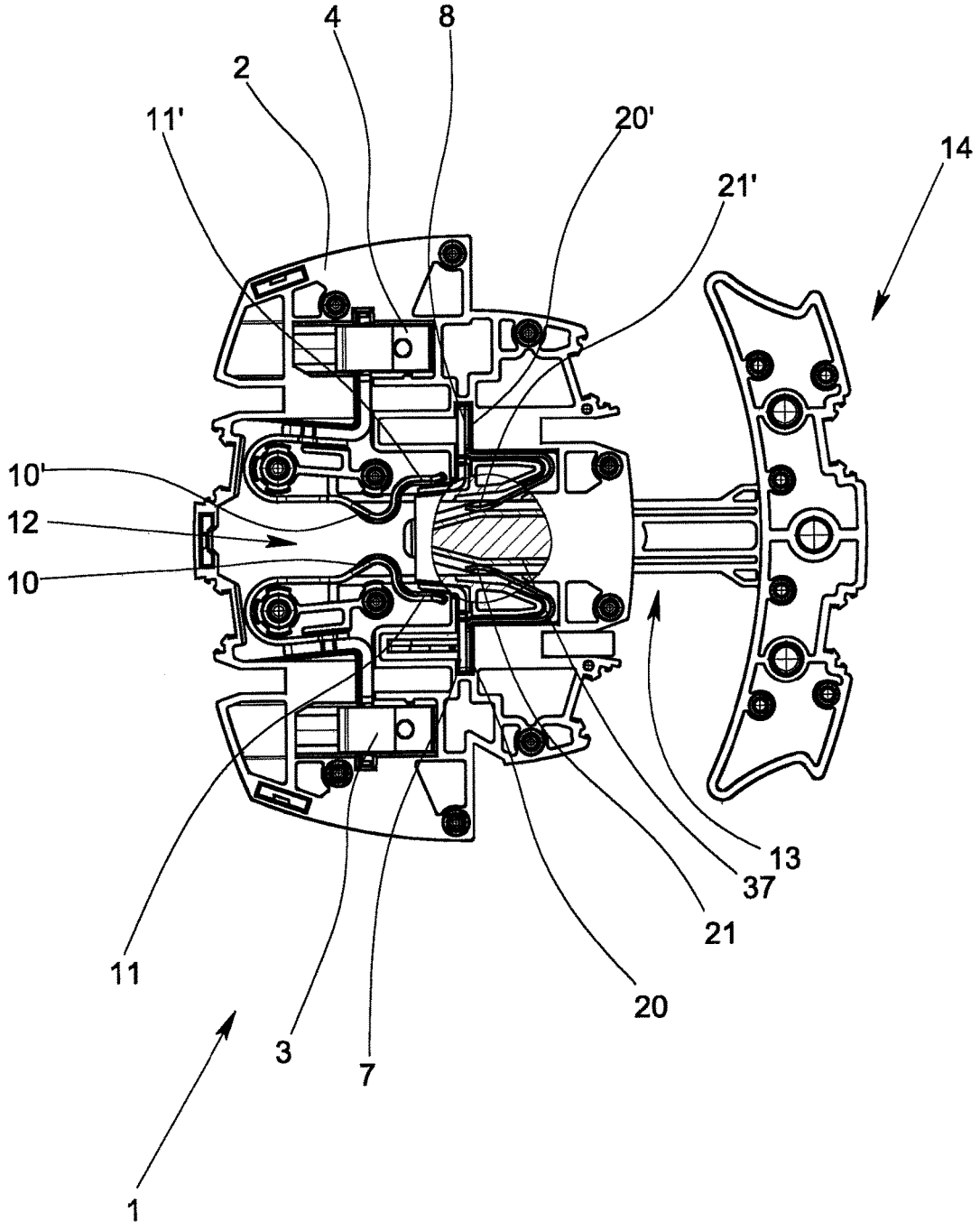
FIG. 3 shows the terminal block with an operating plug which has been plugged into the second contact region.

In FIG. 2, only the tip of the plug 13 is plugged into the opening 23, while in FIG. 3 the plug 13 is plugged further in the plug-in direction E so that the plug 13 is inserted into the second contact region 22. Via the plug 13 which has been inserted into the second contact region 22 an electrically conductive connection takes place between the contact sections 21, 21' of the two spring elements 18, 19, and thus, also between the two conductor connecting elements 3, 4 since the latter are each connected in an electrically conductive manner to the spring elements 18, 19 via the conductor bars 5, 6 and the conductor bar pieces 7, 8, as is shown in FIG. 3. At the same time, with the plug-in jumper 17 plugged in, the cross-jumpering is still closed to an adjacent terminal block 1' via the conductor bar 5 and the conductor bar piece 7 since the second contact section 11 of the conductor bar 5 adjoins the conductor bar piece 7.

Figure 4:
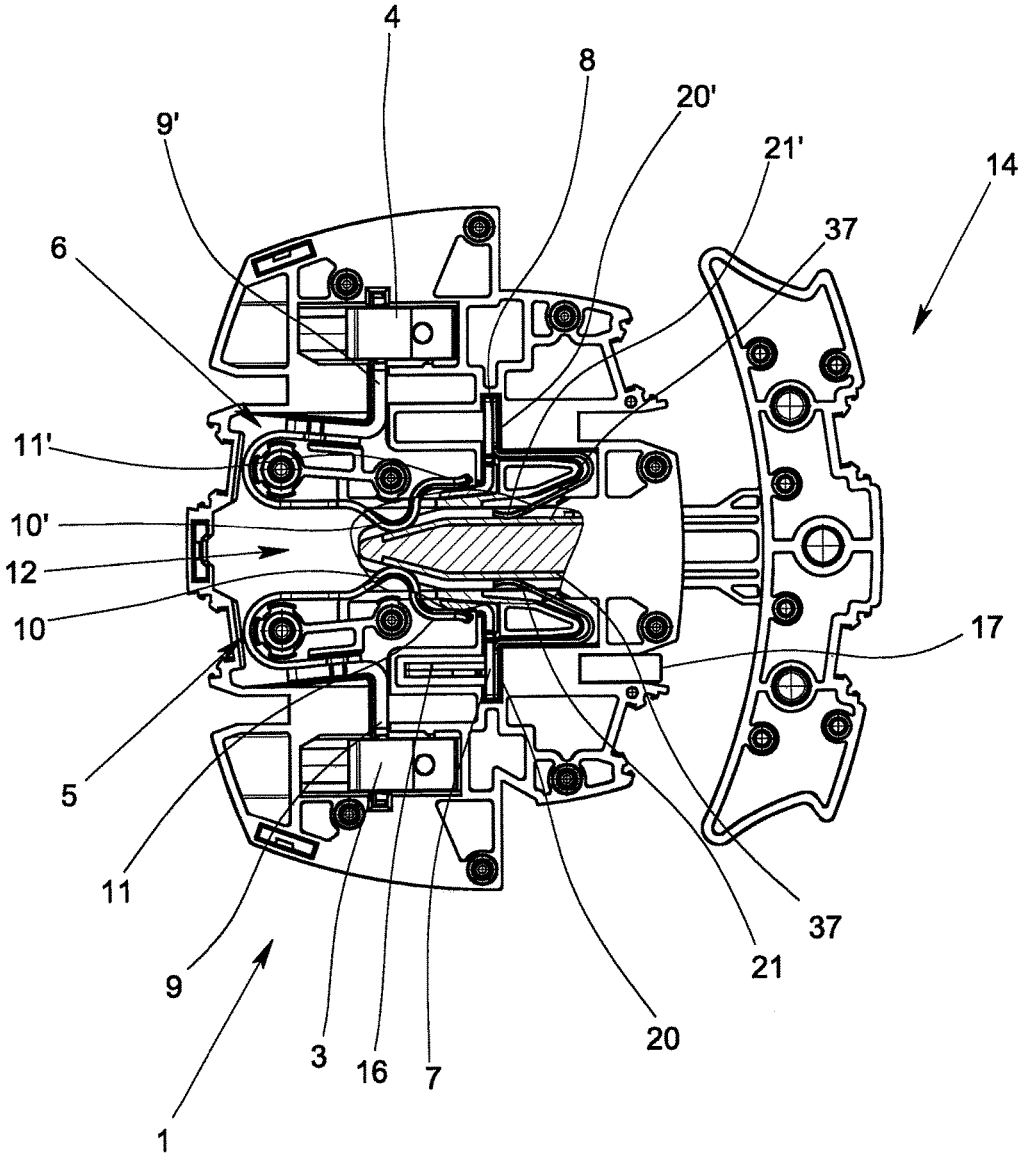
FIG. 4 shows the terminal block with an operating plug which has been plugged somewhat into the first contact region.

In FIG. 4, the plug 13 is plugged into the terminal block 1 to such an extent that the forward, narrower end of the plug 13 also projects into the first contact region 12. In this way, both the first contact sections 10, 10' of the two conductor bars 5, 6 and also the contact sections 21, 21' of the two spring elements 18, 19 are electrically connected to one another. The electrical connection of the two conductor connecting elements 3, 4 thus takes place both in the first contact region 12 and also in the second contact region 22 via the inserted plug 13. In the position of the plug 13 of the operating plug 14 shown in FIG. 4, the second contact sections 11, 11' of the two conductor bars 5, 6 adjoin the conductor bar pieces 7, 8 so that via the conductor bar 5 and the conductor bar piece 7 with the plug-in jumper 17 plugged in, there is furthermore cross-jumpering to the adjacent terminal block P. In addition, the cross-jumpering also takes place via the plug 13, specifically via the conductor bar 5, the plug 13 and the spring element 19.

If the plug 13 is in a slanted position so that it makes contact, for example, with its forward narrower end in the contact region 12 with only one conductor bar 5 and in doing so at the same time deflects the conductor bar 5 such that the contact section 11 does not make contact with the assigned conductor bar piece 7, the connection would be interrupted without the arrangement of the spring elements 18, 19. Since the obliquely positioned plug 13 makes contact with only one conductor bar 5 there would be no electrical connection between the two conductor connecting elements 3, 4. But at the same time, the cross connection to an adjacent terminal block 1' would be interrupted since the conductor bar 5 and the conductor bar piece 7 are no longer connected to one another. The arrangement of the spring elements 18, 19 reliably prevents this fault, since even in an oblique position of the plug 13 via the connection of the plug 13 to the two spring elements 18, 19 in the second contact region 22 both a connection between the two conductor connecting elements 3, 4 is produced and also the cross connection to an adjacent terminal block 1' via the conductor bar 5, the plug 13, the spring element 18 and the plug-in jumper 17 is maintained.

Figure 5:
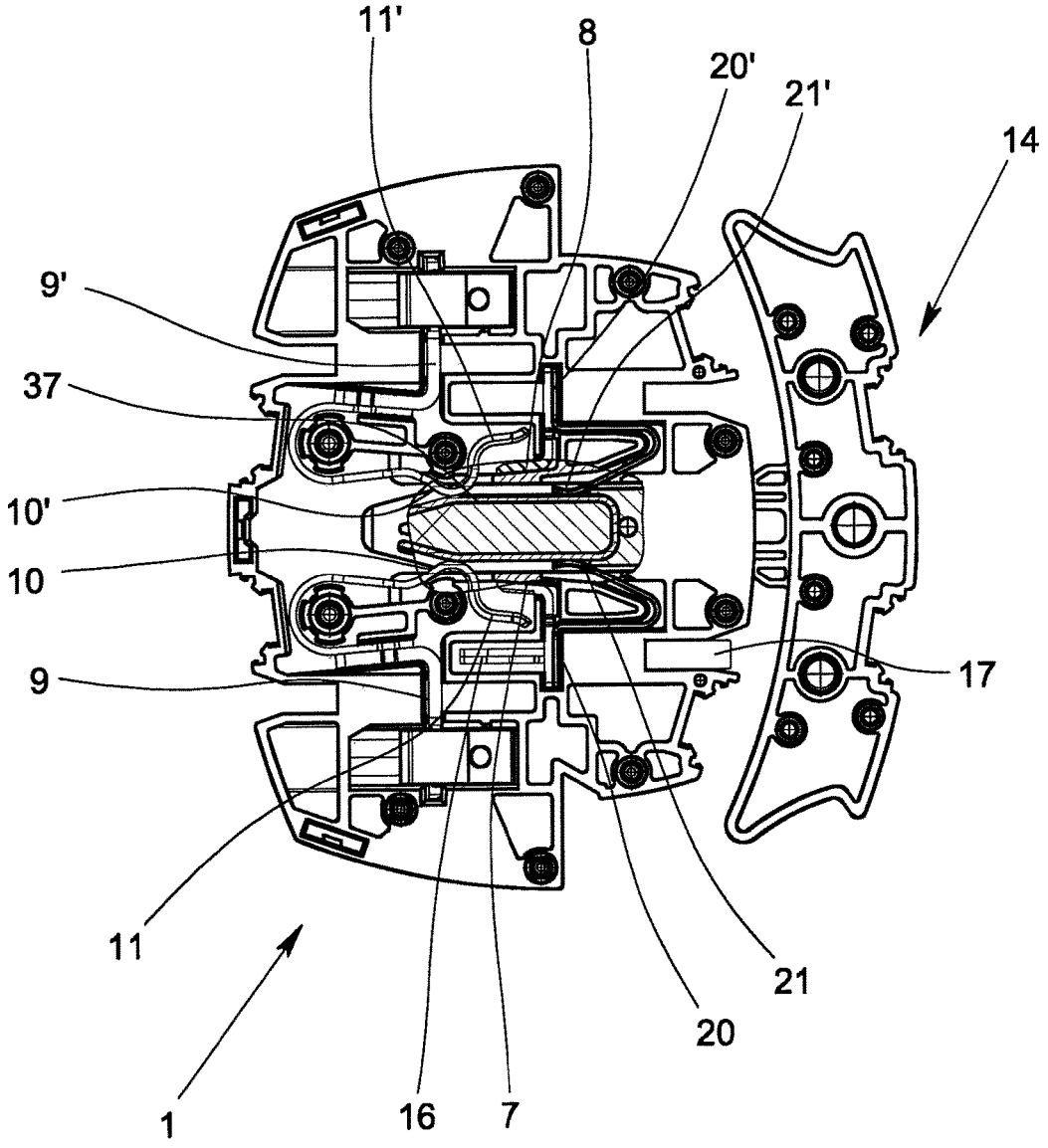
FIG. 5 shows the terminal block with an operating plug which has been plugged into the first contact region.
Figure 6:
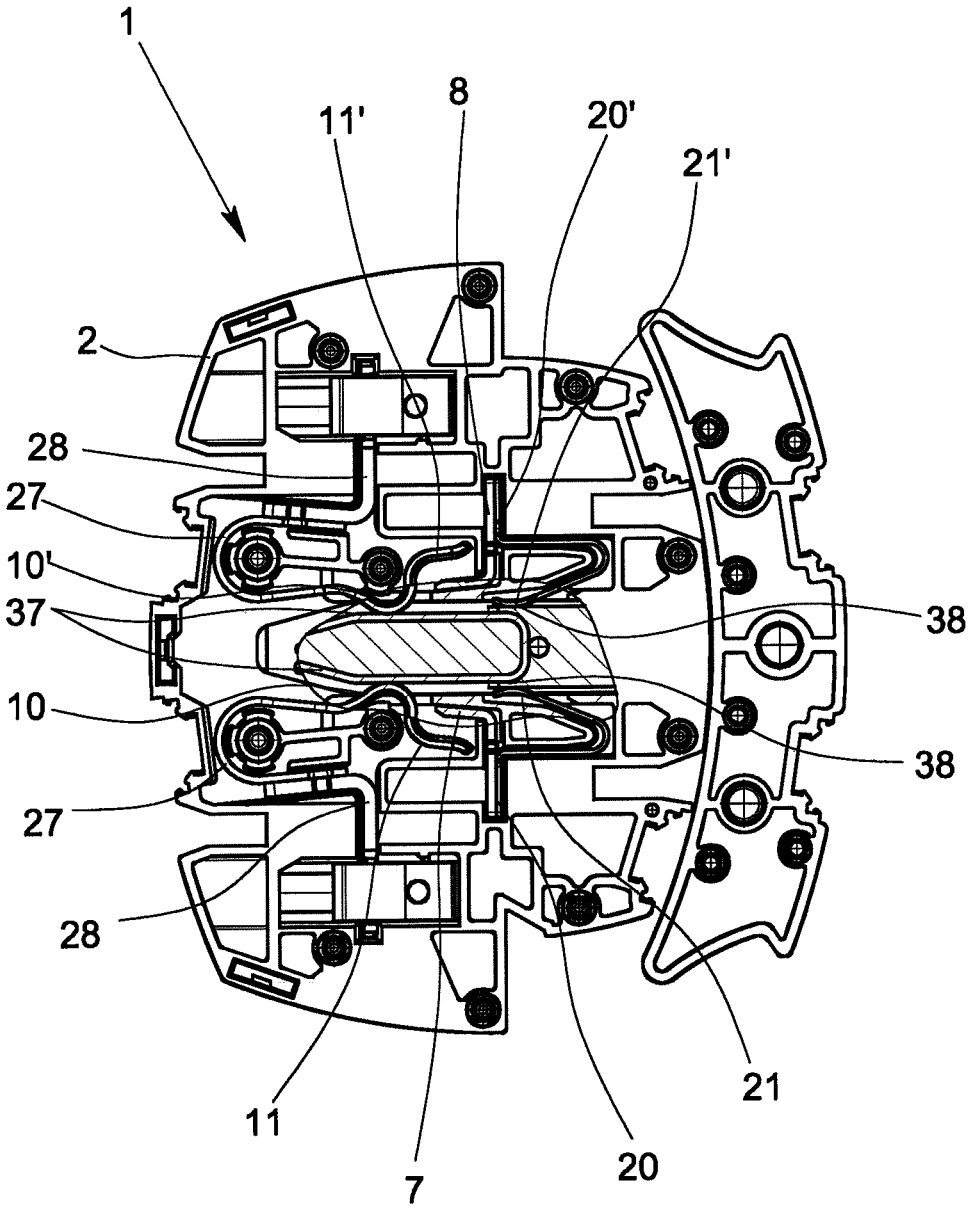

In FIG. 5, the plug 13 of the operating plug 14 has been plugged so far into the electrical terminal block 1 or into the opening 23 formed in the terminal housing 2 that the two first contact sections 10, 10' of the two conductor bars 5, 6 are forced apart from one another by the plug 13 so that the two second contact sections 11, 11' of the conductor bars 5, 6 no longer adjoin the conductor bar pieces 7, 8. Even in this position of the plug 13, however, there is still a cross connection between two adjacent terminal blocks 1, 1' via a plugged-in plug-in jumper 17, specifically from the conductor bar 5 via the plug 13 and the spring element 18 to the leg 16 of the plug-in jumper 17. Only when the plug 13 of the operating plug 14 according to FIG. 6 is fully plugged into the opening 23 in the terminal housing 2, with the plug-in jumper 17 plugged in, is the cross connection to an adjacent terminal block P also interrupted since there is no longer an electrically conductive connection between the conductor bar 5 and the spring element 18 even via the plug 13.

FIGS. 1 to 6 show that an opening 23 is formed in the middle of the terminal housing 2 for plugging the plug 13 of an operating plug 14 or a test plug 15 into the two contact regions 12, 22. Moreover, on the two sides of this opening 23, a respective further opening 24 is formed for plugging the leg 16 of a plug-in jumper 17 into the recesses in the conductor bar pieces 7, 8 and in the connecting sections 20, 20' of the spring elements 18, 19. The openings 23, 24 are all accessible from the first side 25, the operator side, of the terminal block 1. This yields the advantage that, in an arrangement of the terminal block 1 or of a corresponding block of terminal blocks in an opening of a control cabinet wall, both an operating plug 14 or a test plug 15 as well as a plug-in jumper 17 can be plugged into the terminal blocks 1, 1' without the cabinet door having to be opened. The connection of the electrical lines, for example, of a current transformer takes place, on the other hand, from the second side 26, the connection side, which is then located within the control cabinet.

In the exemplary embodiment of the electrical terminal block 1 shown in the figures, the two conductor bars 5, 6 are each formed of two individual elongated metal strips 27, 28 which are soldered, welded or riveted to one another in the transition region. The two connection sections 9, 9' are formed by the first bent metal strips 27 which project into the terminal bodies of the screw-type terminals 3, 4 with their free end. Conversely the two contact sections 10, 10' and 11, 11' of the conductor bar 5, 6 are formed by the two metal strips 28 which are each made as contact springs.

Figure 7:
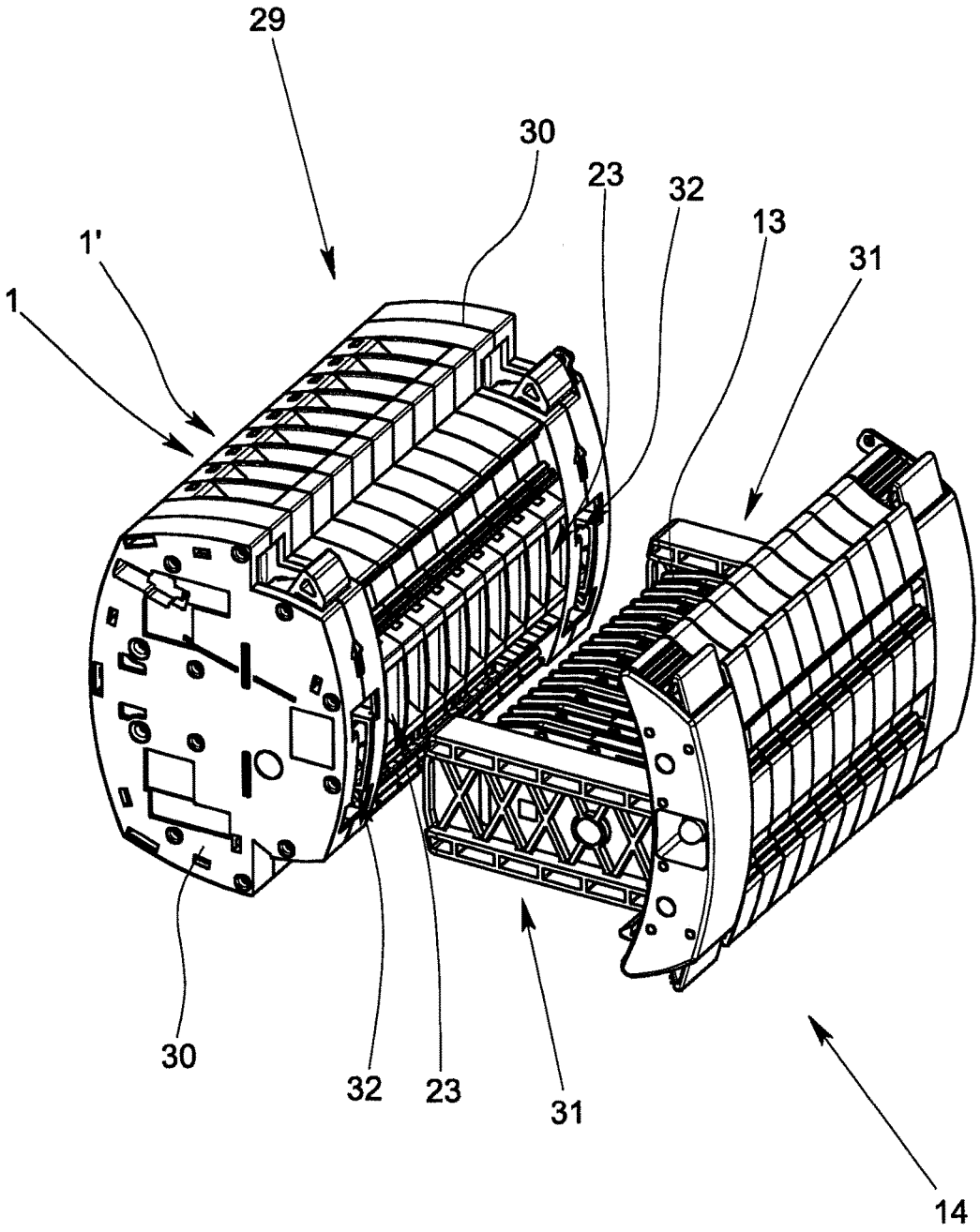
Figure 8:
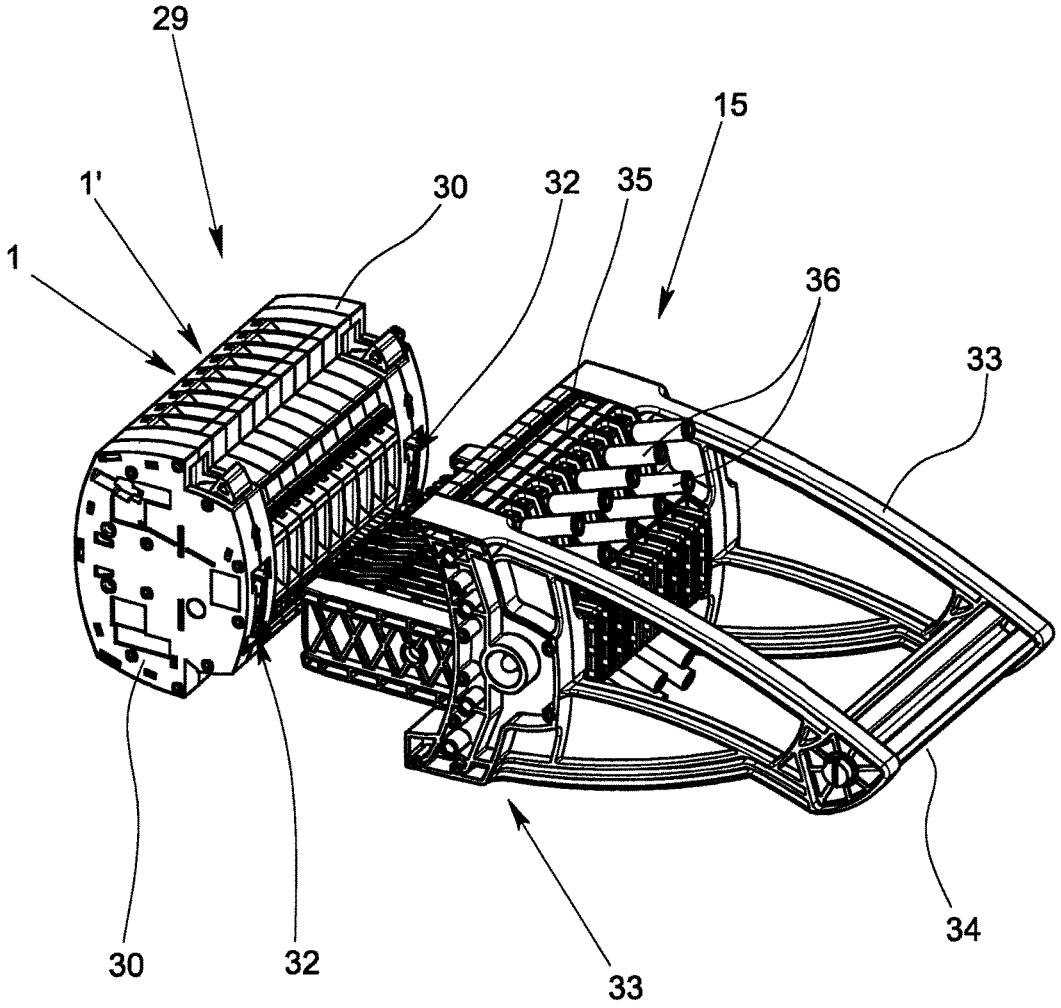

The blocks 29 of terminal blocks which are shown in FIGS. 7 and 8 each are formed of a plurality of interconnected terminal blocks 1, 1' and two mounting terminals 30 which are located on the two sides of the plurality of terminal blocks 1, F. The operating plug 14 shown in FIG. 7 is likewise made modular and has a number of plugs 13 which are likewise connected to one another, which number corresponds to the number of terminal blocks 1, 1'. Moreover, the operating plug 14 laterally has two more mounting parts 31 which are plugged into the corresponding openings 32 in the mounting terminals 30.

The block 29 of terminal blocks shown in FIG. 8 also is formed of a plurality of electrical terminal blocks 1, 1', in turn there being a respective mounting terminal 30 on the two sides of the plurality of terminal blocks 1, 1'. In a manner similar to the operating plug 14, the test plug 15 is also made modular, having a number of plugs 13 which corresponds to the number of terminal blocks 1 and of two mounting parts 33 which are located on the two sides of the plurality of plugs 13 and which in the same manner as the two mounting parts 31 of the operating plug 14 can be plugged into the openings 32 in the two mounting terminals 30. Moreover, the test plug 15 has a grip piece 34 via which the two mounting parts 33 are connected to one another. To connect electrical lines to the plugs 13 of the test plug 15, in the plug housings 35 there are conductor bars with corresponding recesses into which corresponding test sockets or test plugs 36 can be plugged.

In particular, FIGS. 5 and 6 show that the plug 13 of the operating plug 14 has two contact sections 37 which are connected to one another and whose length is smaller than the maximum insertion depth T of the plug 13 into the opening 23 of the terminal block 1. The plugs 13 of the test plug 15 are made accordingly. This ensures that when the plug 13 has been fully plugged into the opening 23 the two contact sections 21, 21' of the spring elements 19, 20 are no longer connected to one another in an electrically conductive manner via the plug 13.

In the fully plugged-in state of the plug 13 the electrically conductive connection of the two conductor connecting elements 3, 4 thus takes place only via the two conductor bars 5, 6 and the plug 13. Moreover, then the cross connection between two adjacent terminal blocks 1, 1' is also cancelled since the two contact sections 21, 21' of the two spring elements 19, 20 are no longer connected to the contact sections 37 of the plug 13. For this purpose, on the side of the contact sections 37 which is facing away from the tip of the plug 13, corresponding insulation sections 38 are formed which in the fully plugged-in state of the plug 13 are in the second contact region 22, i.e., the contact sections 21, 21' of the spring elements 19, 20 each adjoin one insulation section 38 which has been formed on the plug 13.

What is claimed is:

1. An electrical terminal block, comprising:

a terminal housing, at least two conductor connecting elements located in the terminal housing, each of which has two conductor bars and two additional conductor bar pieces, the conductor bars each having a connecting section, a first contact section and a second contact section, the connecting sections each being assigned to one conductor connecting element, the first contact sections together forming a first contact region for accommodating a plug of an operating plug or a test plug and the first contact sections being spaced apart from one another and being connected to one another in an electrically conductive manner via the plug only when the plug is plugged in in at least one of the conductor bar pieces, at least one recess being provided for plugging in a leg of a plug-in jumper, a respective one of the conductor bar pieces being assigned to one of the conductor bars such that the second contact section of a respective conductor bar makes contact with the assigned conductor bar piece when the plug has not been plugged in, while the second contact section of a respective conductor bar is spaced apart from the assigned conductor bar piece when the plug has been plugged into the first contact region, and two spring elements in the terminal housing, each of which has a connecting section and an elastic contact section, each of the spring elements being connected in an electrically conductive manner to a respective one of the conductor bar pieces, wherein the contact sections together form a second contact region for accommodating the plug, the contact sections being spaced apart from one another and being electrically disconnected from each other, when the plug has not been plugged in, and wherein the contact region of the spring elements is located upstream of the contact region of the conductor bars in a plug-in direction of the plug.

2. The electrical terminal block as claimed in claim 1, wherein the elastic contact sections of the two spring elements are each approximately V-shaped.

3. The electrical terminal block as claimed in claim 1, wherein a recess is formed in the connecting section of at least one of the two spring elements which corresponds to a recess in the assigned conductor bar piece.

4. The electrical terminal block as claimed in claim 1, wherein a respective conductor bar piece is tightly joined to a connecting section of the two spring elements by one of having been soldered, welded or riveted thereto.

5. The electrical terminal block as claimed in claim 1, wherein a respective conductor bar piece is formed in one piece with a respective one of the two spring elements.

6. The electrical terminal block as claimed in claim 1, wherein an opening is provided in the terminal housing for plugging the plug of an operating plug or a test plug into the two contact regions and at least one further opening is provided for plugging a leg of a plug-in jumper into the recess in the conductor bar piece, the openings being accessible from a first, operator side of the housing.

7. The electrical terminal block as claimed in claim 1, wherein the two conductor bars each are formed of two individual elongated metal strips which are connected to one another in an electrically conductive manner, each of the two connecting sections being formed by a first metal strip, and the first contact sections and the second contact sections each being formed by a second metal strip.

8. A plug system comprised of a block of terminal blocks, at least one plug-in jumper formed with at least two legs and an operating plug, wherein the block of terminal blocks has at least two terminal blocks which are located next to one another, each of the terminal blocks having:

a terminal housing, at least two conductor connecting elements located in the terminal housing, each of which has two conductor bars and two additional conductor bar pieces, the conductor bars each having a connecting section, a first contact section and a second contact section, the connecting sections each being assigned to one conductor connecting element, the first contact sections together forming a first contact region for accommodating a plug of an operating plug or a test plug and the first contact sections being spaced apart from one another and being connected to one another in an electrically conductive manner via the plug only when the plug is plugged in in at least one of the conductor bar pieces, at least one recess being provided for plugging in a leg of a plug-in jumper, a respective one of the conductor bar pieces being assigned to one of the conductor bars such that the second contact section of a respective conductor bar makes contact with the assigned conductor bar piece when the plug has not been plugged in, while the second contact section of a respective conductor bar is spaced apart from the assigned conductor bar piece when the plug has been plugged into the first contact region, and two spring elements in the terminal housing, each of which has a connecting section and an elastic contact section, each of the spring elements being connected in an electrically conductive manner to a respective one of the conductor bar pieces, wherein the contact sections together form a second contact region for accommodating the plug, the contact sections being spaced apart from one another when the plug has not been plugged in, and wherein the contact region of the spring elements is located upstream of the contact region of the conductor bars in a plug-in direction of the plug;

wherein the operating plug has a number of plugs for plugging into the terminal block corresponds to the number of terminal blocks, wherein a respective leg of the plug-in jumper is plugged into at least one conductor bar piece of a first of the terminal blocks and into a corresponding conductor bar piece of a second of the terminal blocks, and wherein each individual plug of the operating plug has two contact sections which are connected to one another and whose length is less than a maximum plug-in depth of the plugs into the terminal blocks.

9. The plug system as claimed in claim 8, wherein a respective insulation section is connected to a side of the contact sections which faces away from a tip of the individual plugs of the operating plug.

10. The plug system as claimed in claim 8, wherein the terminal blocks are mechanically connected to one another via corresponding latching elements in the terminal housing.

11. A plug system comprising:

a block of terminal blocks, at least one plug-in jumper formed with at least two legs and a test plug, wherein the block of terminal blocks has at least two terminal blocks which are located next to one another, each of the terminal blocks having:

a terminal housing, at least two conductor connecting elements located in the terminal housing, each of which has two conductor bars and two additional conductor bar pieces, the conductor bars each having a connecting section, a first contact section and a second contact section, the connecting sections each being assigned to one conductor connecting element, the first contact sections together forming a first contact region for accommodating a plug of an operating plug or a test plug and the first contact sections being spaced apart from one another and being connected to one another in an electrically conductive manner via the plug only when the plug is plugged in in at least one of the conductor bar pieces, at least one recess being provided for plugging in a leg of a plug-in jumper, a respective one of the conductor bar pieces being assigned to one of the conductor bars such that the second contact section of a respective conductor bar makes contact with the assigned conductor bar piece when the plug has not been plugged in, while the second contact section of a respective conductor bar is spaced apart from the assigned conductor bar piece when the plug has been plugged into the first contact region, and two spring elements in the terminal housing, each of which has a connecting section and an elastic contact section, each of the spring elements being connected in an electrically conductive manner to a respective one of the conductor bar pieces, wherein the test plug has a number of plugs for plugging into the terminal blocks, which number corresponds to the number of terminal blocks, and wherein a respective leg of the plug-in jumper is plugged into at least one conductor bar piece of the first terminal block and into a corresponding conductor bar piece of the second terminal block, and wherein each plug of the test plug has two contact sections whose length is less than the maximum plug-in depth of the plugs into the terminal block.

12. The plug system as claimed in claim 11, wherein a respective insulation section is connected to a side of the contact sections which faces away from a tip of the individual plugs of the test plug.

13. The plug system as claimed in claim 11, wherein the terminal blocks are mechanically connected to one another via corresponding latching elements in the terminal housing.

* * * * *